US007302728B2

(12) United States Patent
Kunz

(10) Patent No.: US 7,302,728 B2
(45) Date of Patent: Dec. 4, 2007

(54) CLEANING IMPLEMENT FOR GOLFERS

(76) Inventor: Coe Kunz, 6880 Howell St., Arvada, CO (US) 80004

( * ) Notice: Subject to any disclaimer, the term of this patent is extended or adjusted under 35 U.S.C. 154(b) by 464 days.

(21) Appl. No.: 10/708,575

(22) Filed: Mar. 11, 2004

(65) Prior Publication Data

US 2005/0198758 A1 Sep. 15, 2005

(51) Int. Cl.
*A63B 47/04* (2006.01)
*A63B 57/00* (2006.01)

(52) U.S. Cl. ..... 15/118; 15/104.93; 15/209.1; 15/210.1; 15/227

(58) Field of Classification Search ..... 15/104.93, 15/104.94, 118, 209.1, 210.1, 227
See application file for complete search history.

(56) References Cited

U.S. PATENT DOCUMENTS 2,179,614 A * 11/1939 Cohen ..... 15/227
3,806,983 A * 4/1974 Cunningham et al. ..... 15/160
4,912,800 A * 4/1990 Zeltner ..... 15/114
5,075,918 A * 12/1991 Zeltner et al. ..... 15/210.1
5,394,914 A * 3/1995 Meek ..... 150/160
5,591,507 A * 1/1997 Jones ..... 428/88
5,761,761 A * 6/1998 An ..... 15/209.1
6,076,224 A * 6/2000 Pacifico et al. ..... 15/210.1
6,226,827 B1 * 5/2001 English, Jr. ..... 15/118

FOREIGN PATENT DOCUMENTS

DE 20012159 U1 * 10/2000
GB 2368536 * 5/2002
WO 00/67855 * 11/2000

* cited by examiner

*Primary Examiner*—Mark Spisich
(74) *Attorney, Agent, or Firm*—Rod D. Baker; Glenn L. Webb

(57) ABSTRACT

Cleaning implements for golfers comprise towels and gloves including abrasive portions for removal of dirt, grass, grass stains, and scuff marks from golf balls, golf clubs, and other golfing equipment. There is disclosed a towel which may include a pocket portion provided with adjacent, but slightly spaced portions or strips of an abrasive material disposable in overlying relationship for use in removing soil from balls and clubs. The towel comprises an attaching mechanism for the purpose of securing the towel to a golf cart or golf bag. The glove or towel according to the disclosure may include portions adapted for treatment, wetting, or impregnation with cleaning or polishing fluids or compounds.

16 Claims, 3 Drawing Sheets

CLEANING IMPLEMENT FOR GOLFERS

BACKGROUND OF INVENTION

Dirt, soil, grass, grass stains, and scuffmarks inevitably accumulate on golf balls, golf clubs, and other equipment during the game of golf. The accumulation of this debris to golf equipment such as the ball or club head can affect the performance of this equipment and thus the score during play. One example of this problem is when debris on a golf ball or the golf club head interferes with the golf stroke. Typically, this problem requires the use of a ball washer, golf towels, or brushes or the combination of all three to clean the soiled area.

The use of such prior cleaning devices can create a number of problems. For instance, a ball washer may not be readily available to the golfer on the fairway. Also, there is a problem with removal of moisture on the golf ball. A ball washer leaves the golf ball wet and thus apt to be miss hit. Typically, this problem requires a golfer to also carry a towel. A ball washer also lacks a scrubbing technique often needed for tough marks, embedded or sticking debris. A golf towel may not always sufficiently clean embedded or hard-sticking debris, and therefore requires additional cleaning equipment to adequately clean the ball, club head or other equipment. Brushes by themselves are not capable of drying and absorbing liquid from a golf ball and also take up excess room in a golf bag.

None of the prior golf cleaning devices satisfactorily provide the ease of a readily available golf implement with abrasive cleaning and drying capabilities. It is therefore desirable to provide such a device that will allow golf equipment to be easily cleaned of all debris in a convenient manner.

SUMMARY OF INVENTION

The present invention accomplishes those needs by providing easily carried or transported cleaning implements for effectively cleaning and removing dirt, soil, grass, grass stains, and scuffmarks from golf balls, golf clubs, and other golf equipment. The present invention discloses several embodiments of implements such as towels and gloves that will clean golf balls, golf clubs, and other golfing equipment in a superior manner.

A preferred embodiment of the present invention provides a towel that includes a pocket portion provided with adjacent, but slightly spaced portions or strips of an abrasive material. This abrasive material enables soil, grass, mud, and other debris to be removed from balls, club heads or other equipment. The pocket portion of the towel may be formed in the towel by the use of permanent fasteners such as stitching, rivets, snaps, grommets or other known fasteners. Alternatively, the pocket may be formed in the towel by selectively disengageable fasteners such as snap fasteners, or cooperating hook and loop fasteners. Selective disengagement of such fasteners allows opening of the pocket for washing of the towel.

In a preferred embodiment of the present invention, the pockets include spaced abrasive portions or strips. The spacing of the abrasive portions or strips facilitates over-folding of the abrasive portions for disposal on opposite side portions of a ball or club. The abrasive may comprise non-metallic scrubbing pad material, hook and loop fastener members of the type sold under the trademark Velcro, abrasive plastic materials, or even artificial turf portions.

In another preferred embodiment of the present invention, the towel is used as an advertising or promotional item. The pocket portion of the towel or other location on the towel provides a location dimensioned and disposed for the display of a logo, golfer's name, or other ornamental or promotional indicia. This embodiment may be sold, given away or otherwise distributed as an advertising medium or as a promotional item.

Another preferred embodiment of the present invention provides an attachment mechanism. The attaching mechanism on the towel enables the towel to be secured to a golf cart, golf bag or even a belt. The attaching mechanism may be a string, cord, snap, or chain or any other type of suitable attachment device. The hole in the towel for the attaching mechanism may be reinforced by stitching or through the use of a plastic or metal grommet, or may alternatively be formed as a slit or slot.

Another preferred embodiment of the present invention utilizes a glove instead of a towel. The glove may be used primarily by a caddy, but may also be employed by a golfer. The glove of this embodiment includes a plurality of abrasive portions for cleaning golf balls, golf clubs, and other golfing equipment. Preferably the abrasive portions are disposed on a palm portion of the glove and on inner surfaces of finger and thumb portions of the glove.

In one alternative embodiment, the glove may be provided with a plurality of abrasive portions formed from different materials having varying degrees of roughness or coarseness graded from an harsh scrubbing material to a soft or smooth polishing material.

In another embodiment the golf cleaning implement, such as a towel or glove, may include portions for treatment, wetting, or impregnation with cleaning or polishing fluids or compounds.

These and other features of the present invention are evident from the drawings along with the detailed description of preferred embodiments.

DETAILED DESCRIPTION

The present invention provides implements for the cleaning of golf balls, golf clubs, additional golfing equipment, as well as for use with other sports equipment and non-sports equipment. It is to be expressly understood that this exemplary embodiment is provided for descriptive purposes only and is not meant to unduly limit the scope of the present inventive concept. Other embodiments, and variations of the present invention are considered within the present inventive concept as set forth of the claims herein. For explanatory purposes only, the preferred embodiments are discussed primarily for use with golf balls and golf clubs. It is to be expressly understood that the present invention may be used with other types of equipment, both sports and non-sports as well.

Figure 1:
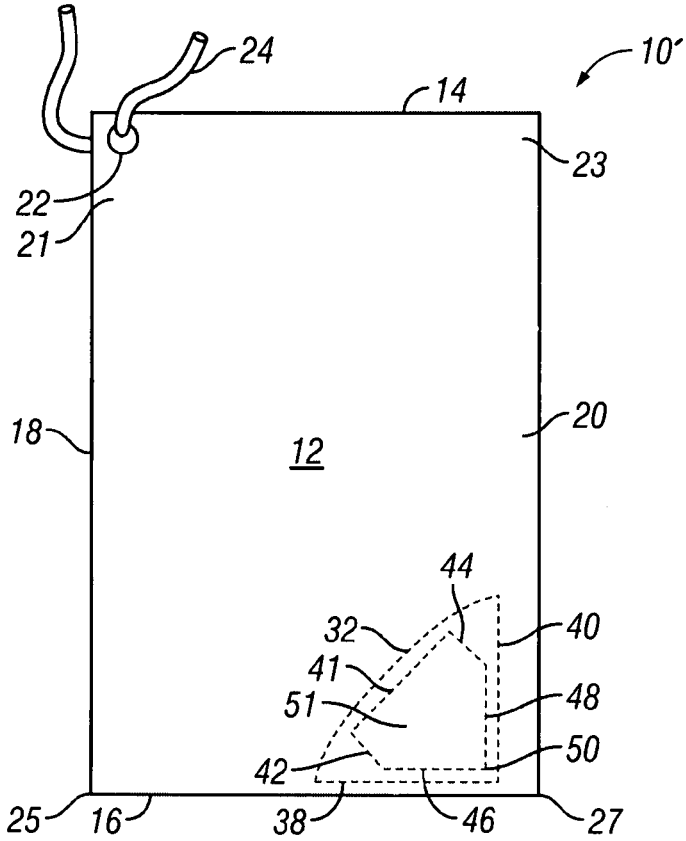
FIG. 1 is a front view of a preferred embodiment of the present invention.

A preferred embodiment of the present invention is illustrated in FIGS. 1-5. Cleaning implement 10, as shown in FIG. 1, includes a towel 12 preferably formed from an absorbent flexible material, such as terry cloth. It is to be expressly understood that other types of material may be used as well, both absorbent and non-absorbent. The towel 12 has a rectangular configuration with respective top and bottom edges 14 and 16 extending in spaced parallel relation and connected by respective elongated side edges 18 and 20. The quadrilateral polygon comprising the towel 12 has top corner portions 21 and 23 and bottom corner portions 25 and 27. It is to be expressly understood that other shapes can be utilized under the present invention as well.

A hole 22 is formed through the towel 12 adjacent the top corner portion 21. This hole 22 receives an attaching mechanism 24 there through for the purpose of securing the towel 12 to a golf cart, golf bag, belt, or other suitable article. The attaching mechanism 24 can be a string, cord, snap, chain or other suitable attaching device. The hole 22 may be reinforced by stitching or through the use of a plastic or metal grommet, or may alternatively be formed as a slit or slot instead of the illustrated circular aperture.

Figure 2:
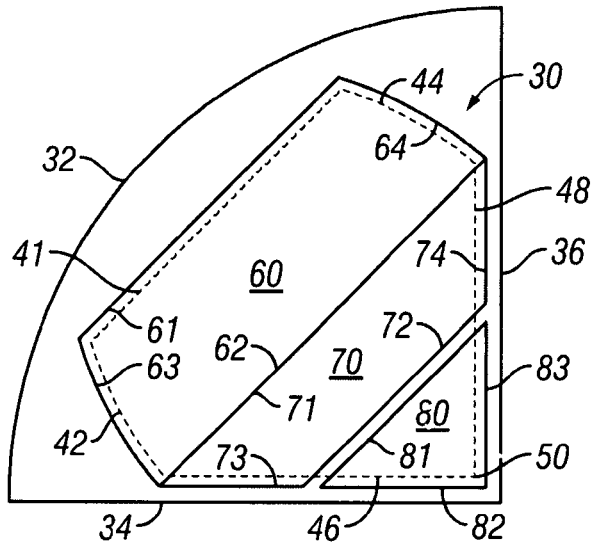
FIG. 2 is a front view of an inner face of a pocket portion of the embodiment of FIG. 1.

With reference to FIGS. 1 and 2, a pocket 30 attached to the towel 12 adjacent the bottom corner portion 27 is secured to the towel 12 by perpendicular seam portions 38 and 40, leaving an arcuate open top edge 32. Additional seams 41, 42, 44, 46, and 48 define an outer periphery of securement of three abrasive strips 60, 70, and 80, in a manner to be described in more detail subsequently. The seams 41, 42, 44, 46 and 48 extend through the pocket 30 forming an exterior badge-shaped region 51 having an apex 50. The badge-shaped region 51 is adapted for the display of identifying or promotional indicia that may be affixed in a variety of different manners in accordance with the intended scope and content of the present invention. For example, such indicia may be directly embossed, painted, printed, or embroidered onto the area 51. Alternatively, such indicia may be formed on a separate element and provided with suitable fasteners for detachable securement, such as cooperating snap fasteners, or cooperating hook and loop type fasteners of the type sold under the trademark Velcro. It is also to be expressly understood that the identifying, promotional or advertising region may be formed on other locations on the towel.

As shown in FIG. 2, an inner face of the pocket 30 is defined by substantially perpendicular side edge portions 34 and 36 connected by an arcuate open top edge 32. Three abrasive strips or regions 60, 70, and 80 are secured to the inner face of the pocket 30 in a slightly spaced relation by the seams 41, 42, 44, 46, and 48. The first abrasive strip or region 60 includes longitudinal edge portions 61 and 62 connected at opposite ends by end edge portions 63 and 64. A second abrasive strip or region 70 includes longitudinal edge portions 71 and 72 connected at opposite spaced ends by end edge portions 73 and 74. A third triangular shaped abrasive strip or region 80 includes substantially perpendicular sides 82 and 83 connected by an edge portion 81. The abrasive strip or region 60 is preferably secured by stitching to the pocket 30 along the edges 61, 63, and 64, leaving the longitudinal side edge 62 open for the potential insertion or storage of items or material in the pocket formed between the inner surface of the pocket 30 and the abrasive strip or region 60. The abrasive strip or region 70 is preferably stitched only along edges 73 and 74 to allow insertion of items or materials underneath the strip or region 70. The abrasive strip or region 80 is preferably secured by stitching along the edges 82 and 83, leaving the edge portion 81 open for the potential insertion of items or materials.

The abrasive strips or regions 60, 70, and 80 are preferably formed from strip s of hook type fastening members of the type sold under the trademark Velcro. Alternatively the abrasive strips or regions may be formed from a nonmetallic material of the type commonly employed for forming cleaning or scouring pads. Another material for creating the abrasive regions includes artificial turf. It is to be expressly understood that other abrasive materials may be used as well, particularly those that will scour the ball, club head or other equipment without permanently scarring or scratching the surface being cleaned.

In a preferred embodiment of the present invention either the pocket face 30 or the strips or regions 60, 70, and 80 may be treated, saturated, or impregnated with a cleaning, scouring, or polishing solution or material. In this preferred embodiment, the inner surface of the pocket 30 in the region underlying the strips 60, 70, and 80 may be provided with a waterproof liner to prevent cleaning solution disposed on or beneath the strips 60, 70, and 80 from wetting an outer surface of the pocket 30. The pocket 30 is preferably formed from the same material as the towel 12.

In use, a golfer or caddy inserts a golf ball, golf club head, or other item through the open top portion 32 of the pocket 30 into contact with one or more of the abrasive strips or regions 60, 70, and 80. The flexible material of the towel 12 and pocket 30, in conjunction with the slight spacing of the strips 68, 70, and 80, allows the pocket 30 to be over folded such that the abrasive strips 68, 70, and 80 may be disposed in at least partially surrounding relation with a club head or ball to be cleaned.

In connection with the alternative embodiment in which cleaning fluid, or cleaning solution, or polishing compound is provided in the region of the pocket 30 disposed beneath one or more of the strips 60, 70, and 80, a user disposes the ball or club head beneath one or more of the strip 60, 70, and 80 to transfer cleaning or polishing solution to the ball or club head.

Additionally, the equipment need not be limited to golf equipment. The cleaning implement could be used for various sports equipment, such as croquet or polo.

In one alternative embodiment of the present invention, the abrasive strips or regions 60, 70, and 80 may be formed with different materials having different textures to provide differing degrees of surface roughness or coarseness. For example, one of the strips 60, 70, or 80 may be formed from hook type fastening material, with one or more of the other strips formed from a nonmetallic scouring pad material.

For cleaning purposes, a user may turn the pocket 30 inside out, remove the attaching mechanism 24, and wash the entire cleaning implement in a washing machine.

Figure 3:
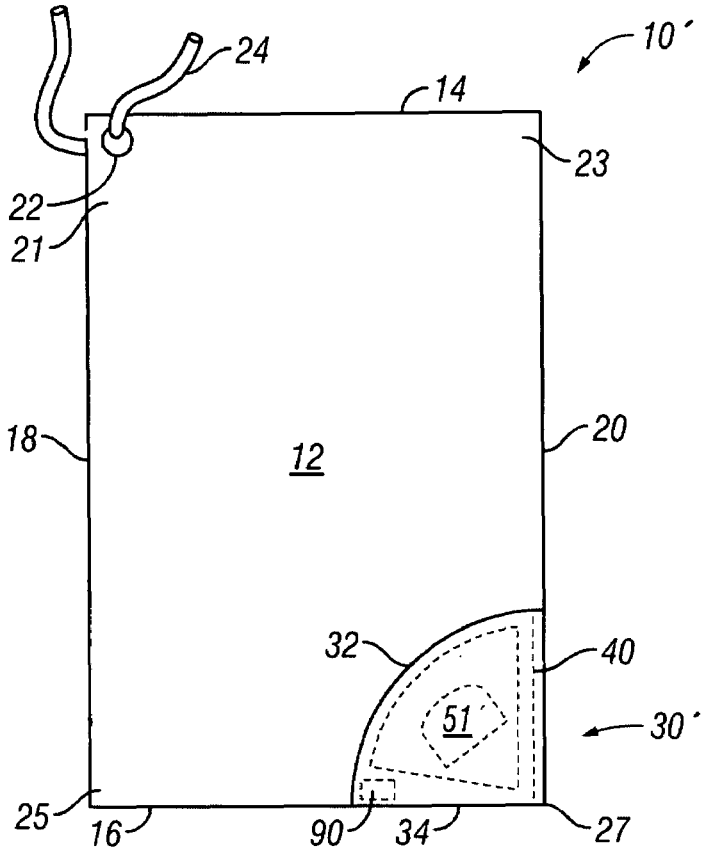
FIG. 3 is a front view of an alternative embodiment of the present invention.
Figure 4:
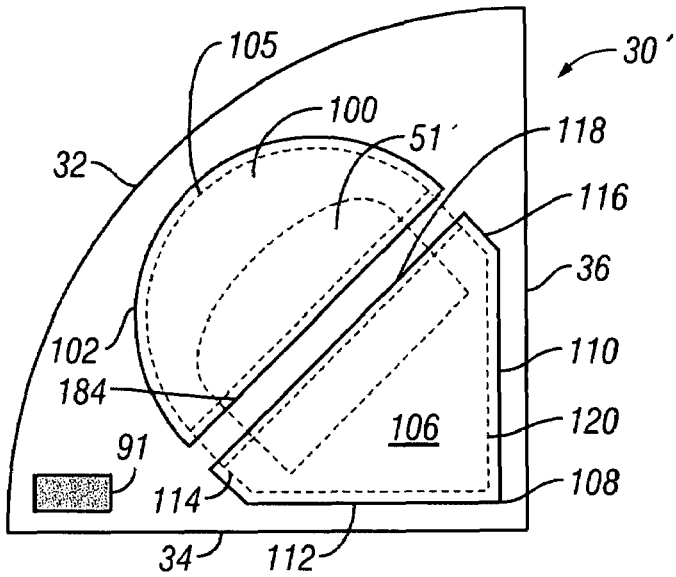
FIG. 4 is a front view of an inner face of a pocket portion of the embodiment of FIG. 3.

FIGS. 3 and 4 illustrate another preferred embodiment of the present invention. A golf cleaning implement 10' is illustrated that is similar in most respects to the previously described embodiment 10 discussed above with reference to FIGS. 1 and 2. The same reference numbers have been used to designate common features of the cleaning implements 10 and 10', and the descriptions of such similar features will not be repeated. The embodiment 10' includes a pocket portion 30' having a somewhat different construction from the pocket 30 illustrated and discussed previously with reference to FIGS. 1 and 2.

With reference to FIGS. 3 and 4, the alternative pocket 30' is sewn to the towel 12 by a seam 40 extending along the edge 36 of the pocket 30'. The perpendicular edge 34 and upper arcuate edge 32 are preferably not sewn or otherwise permanently affixed to the towel 12, allowing the flap of the pocket 30' to be folded to a substantially open configuration.

Cooperating fasteners 90 are preferably provided on the towel 12 and the pocket 30' in a region proximate the intersection of the pocket 30' edges 34 and 32. The cooperating fasteners 90 allow the pocket 30' to be selectively secured in the closed configuration illustrated in FIG. 3. The cooperating fasteners 90 may take a variety of conventional forms such as snap fasteners or cooperating hook and loop fasteners of the type sold under the trademark Velcro. For example, as shown in FIG. 4, the pocket 30' may be provided with a small strip of hook type fastening material adapted for selective engagement with a complementary strip of loop type fastening material (not shown) sewn or adhesively secured on to the towel 12.

With reference to FIG. 4, the pocket 30' includes a first abrasive strip or cleaning member 100 having a generally semi-circular shape and including an arcuate edge 102 and a straight edge 104. A sewn seam 105 extends just within the periphery of the abrasive member or portion 100, affixing the same to the inner face of the pocket 30'. A second abrasive member or portion 106 includes diverging straight edge portions 110 and 112 intersecting at an apex 108. Opposite end portions of the edges 110 and 112 terminate at respective intersections with a pair of spaced, parallel, symmetrically disposed side edges 114 and 116 which are, in turn, connected by a straight edge 118 disposed in spaced parallel relation with the edge 104 of the first abrasive member or portion 100. A sewn seam 120 extends just within the periphery of the second abrasive member 106, substantially permanently securing the member or portion 106 to the inner face of the pocket 30'. The slight spacing of the first 100 and second 106 abrasive members or portions facilitates over folding and manual manipulation of the abrasive portions 100 and 106 in engagement with a golf ball, golf club head, or other golf related equipment.

In another preferred embodiment, an indicia display region 51' is preferably provided to allow the display of endorsement, promotional, or identifying indicia on the exterior face of the pocket 30' as shown in FIG. 3. The indicia may be imprinted, embossed, sewn, or removably attached by cooperating fastening members such as hook and loop fastener members of the type sold under the trademark Velcro. Other types of fastening mechanisms may be used as well.

Figure 5:
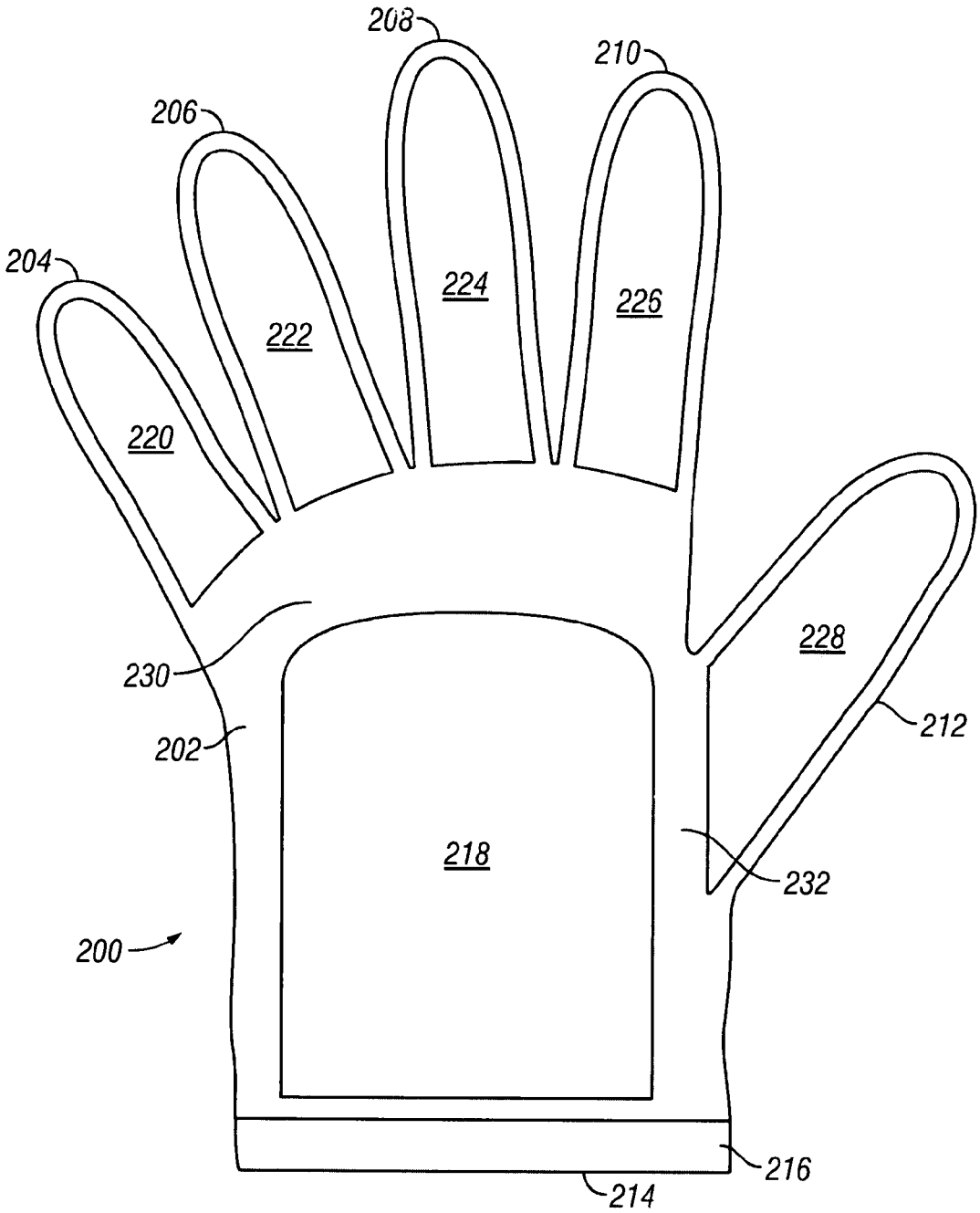
FIG. 5 is a front view of a third embodiment of the present invention.

Another alternative preferred embodiment is illustrated in FIG. 5. Cleaning implement 200 according to a preferred embodiment of the present invention includes a glove having a palm region 202 connected in a conventional manner to finger regions 204, 206, 208, 210, and a thumb region 212. A bottom edge of the glove 200 terminates in a wrist opening 214 provided with a cuff 216. The glove 200 may be formed from leather, fabric, or synthetic materials, in a manner similar to a conventional golf glove. Alternatively, the cleaning implement glove 200 according to the present invention may be formed by retrofitting a conventional golf glove with abrasive cleaning and/or polishing portions in a manner to be described subsequently.

In another preferred embodiment, a generally conventional glove is provided with a plurality of scrubbing, cleaning, and or polishing members or portions to 218, 220, 222, 224, 226, and 228, disposed, as illustrated, respectively, on palm, finger, and thumb portions of the glove 200. In accordance with the present invention, the regions 218, 220, 222, 224, 226, and 228 may be formed from different materials so as to provide materials having different surface textures to facilitate different types or degrees of cleaning and/or polishing. The regions or portions may be formed from materials including nonmetallic scouring pad material, hook or loop type fastener material, and cloth or felt cleaning pads or cloths.

Another embodiment of the above described implement provides one or more of the regions 218, 220, 222, 224, 226, and 228 may be treated or impregnated with a cleaning or polishing compound or solution. The cleaning regions or portions may be sewn or adhesively secured to the bottom or palm face of the glove 200. Alternatively, the cleaning regions or portions may be detachably secured to the glove 200 by cooperating fasteners such as snaps or hook and loop type fasteners of the type sold under the trademark Velcro or other types of fasteners. This alternative construction allows selective replacement of the portions to change the surface texture, for cleaning, or to replace a worn component. Only one or two of the abrasive scrubbing or cleaning portions 218, 220, 222, 224, 226, and 228 may be employed, in accordance with the scope of the present invention. For example, the cleaning implement glove 200 may omit the regions or portions 220, 222, and 224, if desired.

The cleaning implement glove 200 as described above is preferably worn by a caddy to conveniently and readily maintain golf balls and golf clubs by cleaning, scrubbing, polishing, and thus ready for immediate use.

The present inventive concept, as set forth in the accompanying claims, covers not only the described embodiments but other embodiments, variations and configurations of the cleaning implement as stated in the accompanying claims.

The invention claimed is:

1. A cleaning implement for cleaning golf equipment, comprising:

a towel comprising a flexible fabric material; and a flexible pocket secured to said towel, said pocket including an inside surface overlying and facing the towel, said pocket having at least two abrasive regions attached therein and to the inside surface of the pocket, said abrasive regions having adjacent edges separated to define a space there between, and said pocket being foldable along said space to dispose said abrasive regions in spaced, at least partially overlying relationship, whereby an item to be cleaned may be placed between said at least partially overlying abrasive regions for cleaning.

2. The cleaning implement of claim 1, wherein at least one of said abrasive regions comprises hook or loop fastening material of the type used in cooperating hook and loop fasteners.

3. The cleaning implement of claim 1, wherein each of said abrasive regions comprises hook or loop fastening material of the type used in cooperating hook and loop fasteners.

4. The cleaning implement of claim 1, wherein each of said abrasive regions comprises hook or loop fastening material of the type used in cooperating hook and loop fasteners, with both of said abrasive regions comprising the same type of fastening material such that said regions will not stick together.

5. The cleaning implement of claim 1, wherein at least one of said abrasive regions comprises a non-metallic scrubbing material.

6. The cleaning implement of claim 1, wherein said abrasive regions comprise different abrasive materials having different textures.

7. The cleaning implement of claim 1, wherein said pocket is attached in a corner region of said towel.

8. The cleaning implement of claim 7, further comprising ornamental or promotional indicia secured to said towel.

9. The cleaning implement of claim 1, wherein said pocket is at least partially stitched to said towel.

10. The cleaning implement of claim 1, wherein said pocket is at least partially secured to said towel by a releasable fastener, such that said pocket may be at least partially opened.

11. The cleaning implement of claim 10, wherein said releasable fastener comprises snap fasteners.

12. The cleaning implement of claim 10, wherein said releasable fastener comprises cooperating hook and loop type fasteners.

13. A cleaning implement for use in cleaning golf equipment, comprising:

a towel comprising a flexible fabric material;

a flexible pocket secured to said towel said pocket including an inside surface overlying and facing the towel; and at least two abrasive regions attached to the inside surface of said pocket and having adjacent edges in spaced relation, wherein said pocket includes a first edge portion stitched to said towel and a second edge portion secured to said towel by releasable fasteners, such that said pocket may be moved from a closed position parallel to said towel to an at least partially opened position, whereby said pocket may be folded to dispose said abrasive regions in spaced, at least partially overlying relationship, whereby an item to be cleaned may be placed between said abrasive regions for cleaning.

14. The cleaning implement of claim 13, wherein said pocket is disposed at a corner region adjacent a first end of said towel and further comprising an attaching mechanism for attaching said towel to a golf bag or cart secured adjacent a second end of said towel substantially opposite said first end.

15. A cleaning implement for use in cleaning golf equipment, comprising:

a substantially rectangular towel having first and second opposite ends at respective top and bottom edges, said top and bottom edges connected by substantially parallel side edges, said towel comprising an absorbent flexible fabric material;

a pocket secured to said towel at a corner of said towel adjacent said first end, said pocket having two substantially perpendicular edge portions, one of said perpendicular edge portions extending substantially parallel to and stitched to a side edge portion of said towel, the other of said perpendicular edge portions extending substantially parallel to and secured by releasable fasteners to said bottom edge portion of said towel, whereby said pocket may be selectively opened;

at least two abrasive regions attached in spaced relation on an interior face of said pocket, said abrasive regions dimensioned and disposed for folding into spaced, at least partially overlying relationship, whereby an item to be cleaned may be placed between said abrasive regions for cleaning; and an attaching mechanism for attaching said towel to a golf bag or cart secured adjacent said second end of said towel at a top corner of said towel substantially diagonally opposite said pocket.

16. A cleaning implement for use in cleaning golf equipment, comprising:

a substantially rectangular towel comprising an absorbent flexible fabric material;

a pocket secured to said towel at a corner of said towel, said pocket including and interior face overlying and facing the towel and further having two substantially perpendicular edge portions, one of said perpendicular edge portions attached to said towel and extending substantially parallel to a side edge portion of said towel, the other of said perpendicular edge portions secured by a releasable fastener to said towel, whereby said pocket may be selectively opened to permit at least two abrasive regions attached in spaced relation on the interior face of said pocket to be folded into at least partially overlying relationship, whereby an item to be cleaned may be placed between said overlying abrasive regions for cleaning.

* * * * *